US006986175B2

(12) United States Patent
Maas

(10) Patent No.: US 6,986,175 B2
(45) Date of Patent: Jan. 17, 2006

(54) JACKKNIFE STYLE CONVERTIBLE BED WITH STORAGE COMPARTMENT SUPPORT

(75) Inventor: Patrick Maas, Dubuque, IA (US)

(73) Assignee: Flexsteel Industries, Inc, Dubuque, IA (US)

( * ) Notice: Subject to any disclaimer, the term of this patent is extended or adjusted under 35 U.S.C. 154(b) by 0 days.

(21) Appl. No.: 10/726,912

(22) Filed: Dec. 3, 2003

(65) Prior Publication Data

US 2004/0107498 A1 Jun. 10, 2004

Related U.S. Application Data

(60) Provisional application No. 60/430,566, filed on Dec. 3, 2002.

(51) Int. Cl.
*A47C 17/16* (2006.01)

(52) U.S. Cl. ..... 5/37.1; 297/92

(58) Field of Classification Search ..... 5/37.1; 297/92; 296/65.09, 69
See application file for complete search history.

(56) References Cited

U.S. PATENT DOCUMENTS

| | | | |
|---|---|---|---|
| 1,734,214 | A | 11/1929 | Jones |
| 1,962,528 | A | 6/1934 | Rope |
| 2,429,260 | A | 10/1947 | Coopersmith |
| 3,059,964 | A | 10/1962 | Hoppe et al. |
| 3,165,350 | A | 1/1965 | Willson |
| 3,751,740 | A | 8/1973 | Belk |
| 3,844,608 | A | 10/1974 | Freedman |
| 4,253,205 | A | 3/1981 | Mikos |
| 4,654,902 | A | 4/1987 | Shrock et al. |
| 5,271,109 | A | 12/1993 | Markel et al. |
| 6,082,805 | A | 7/2000 | Gray et al. |

OTHER PUBLICATIONS

Three sheets blueprint drawings, Flexsteel Industries, Inc., Rollover Truck Camper Bed.

*Primary Examiner*—Alexander Grosz
(74) *Attorney, Agent, or Firm*—Barnes & Thornburg LLP; David C. Brezina; Mark J. Nahnsen

(57) ABSTRACT

A convertible sofa bed for recreational vehicles having a storage compartment under the seat bottom provides access to the storage compartment by enabling the raising the seat bottom and supporting the seat bottom by a ratcheting mechanism enabling the seat bottom to be raised to a storage access position, and raised again to unlock and then lowered to a seating position, this motion being accomplished without the use of a separate release for a dead bolt type lock.

14 Claims, 3 Drawing Sheets

JACKKNIFE STYLE CONVERTIBLE BED WITH STORAGE COMPARTMENT SUPPORT

CLAIM OF PRIORITY

This application claims priority on Provisional Application Serial No. 60/430,566 filed Dec. 3, 2002, having the same title as this invention.

BACKGROUND OF THE INVENTION

The invention is a convertible sofa bed for recreational vehicles having a storage compartment under the seat bottom. Access to the storage compartment is provided by raising the seat bottom. The seat bottom is supported by a ratcheting mechanism enabling the seat bottom to be raised to a storage access position, and raised again to unlock and then lowered to a seating position, this motion being accomplished without the use of a separate release for a dead bolt type lock.

DESCRIPTION OF RELATED ART

Preexisting "Jackknife Hinge Assemblies" have a pair of arms connected by a crossbar or link, however, the lock bracket and related assembly is absent, and the swing bracket (38) is absent. Instead of the configuration of the current invention in which back hinge (36) and seat hinge (42) each connecting through the swing bracket (38), in the older designs the equivalents of the back and seat hinges connect directly to one another.

On early Jackknife sofas, the left and right linkages were kept in time with one another by the seat frame. In addition the seat frame acted as a stop "lock" in both a seating and bed position. Upon development of newer linkages a timing bar performs these functions. The timing bar also acts as a stop to hold the linkage and back frame while the seat is rotated up to access the storage area. There is also a helper spring.

A patent on a Jackknife bed mechanism is U.S. Pat. No. 6,082,805 issued to Gray, et al. Jul. 4, 2000 entitled "Multipurpose recreational vehicle seat having storage compartment access".

A lock design using a butterfly ratchet is used on fold-out sofa sleeper couch mechanisms to hold the head of the bed unit in a "TV" position. An example is U.S. Pat. No. 4,253,205 issued to Mikos on Mar. 3, 1981 entitled "Sofa-sleeper." This has a "TV slotted link 200" co-acting with "TV support link 208" operatively supported by the movement of "butterfly member 218."

DETAILED DESCRIPTION OF THE PREFERRED EMBODIMENT

Figure 1:
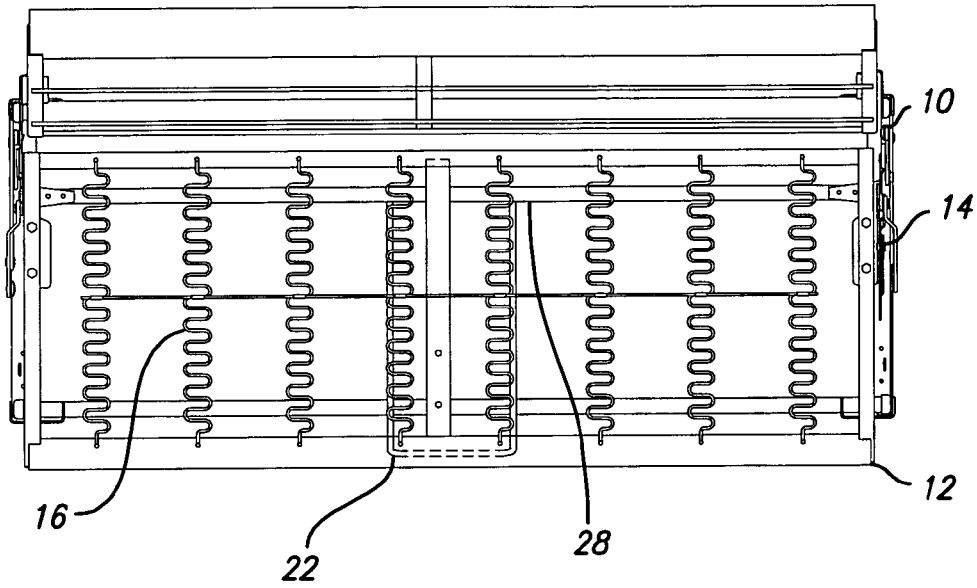
FIG. 1 is a top plan view of a convertible sofa sleeper in the seating position.
Figure 2:
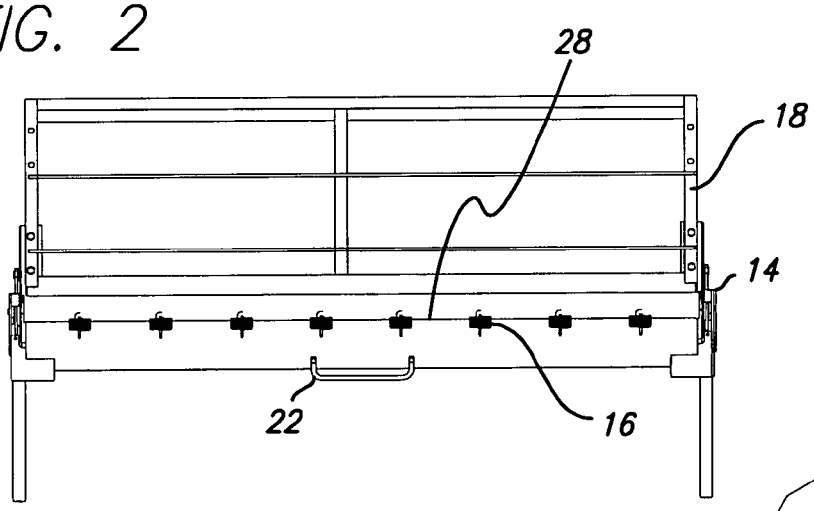
FIG. 2 is a front elevational view of a convertible sofa sleeper in the seating position.

A seat (10) for a recreational vehicle is convertible between a sofa position and a bed position. The seat (16) is mounted on a frame support (30). Frame (12) defines a storage area thereunder. Frame (12) could be metal legs with appropriate walls or a wooden structure. The mechanism (14) interconnects the seat bottom (16) and back (18) so that bottom (16) pivots to provide access to the storage area. Seat bottom (16) is lifted at its front (20) and when lifted to a selected height, is maintained in a raised position by support (24). Handle (22) attaches to the bottom of the timing bar (28).

The side frame (30) has a rear swing link (32) and a front swing link (34) pivotally attached thereto at the lower ends of the respective links. At the upper end of rear swing link (32) is attached back hinge (36). The pivot to back hinge (36) is approximately in the middle of back hinge (36). The bottom end of back hinge (36) is pivotally connected to swing bracket (38) at the top, rear of swing bracket (38). The top, front of swing bracket (38) connects to the top of front swing link (34). The mechanisms may be mirror images of one another on the left and right sides, respectively. The description here applies to either side.

It will be noted that each swing bracket (38) has an inwardly turning flange which respective flanges have timing bar (28) bolted thereto. In this manner, motion imparted by handle (22) is directly transmitted to the respective swing bracket (38) on each side of the piece of furniture, thus assisting in the complex motion of the linkage shifting from a seating to a bed position.

The middle of rear swing link (32) and a front swing link (34) are interconnected by swing tie link (40). At the top, middle of swing bracket (38), seat hinge (42) is pivotally connected. Finally at the bottom of swing bracket (38) is pivotally connected lock bracket (44) at the rear end of lock bracket (44).

Figure 4:
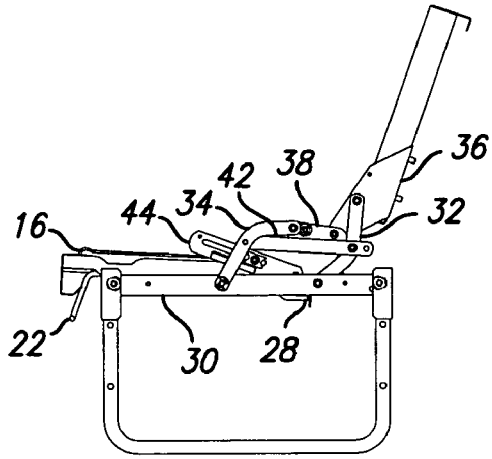
FIG. 4 is a side elevational view of the convertible sofa sleeper in the seating position.
Figure 6:
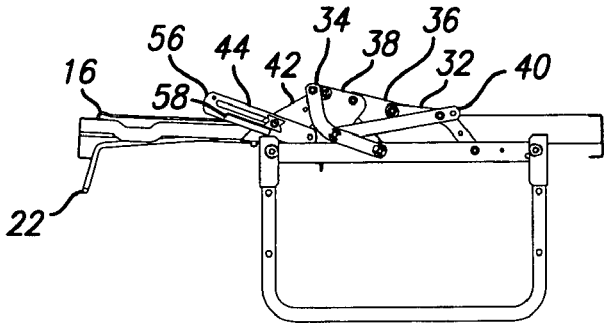
FIG. 6 is a side elevational view of the convertible sofa sleeper in the bed position.

In shifting from a seating position (FIG. 4) to a bed position (FIG. 6), as the handle (22) of seat (10) is lifted, the entire mechanism (14) raises on the bottom pivots (62) of the front and rear links. The seat bottom (16) raises at its front and is fixed relative to the swing bracket (38) because of the lock. Thus, the seat bottom (16), seat hinge (42) and swing bracket (38) all pivot around the swing bracket pivot. The entire mechanism (14) moves forward and down, the front of the seat bottom moves down, and the seat back pivots around its pivot on the swing bracket to a bed position.

Figure 5:
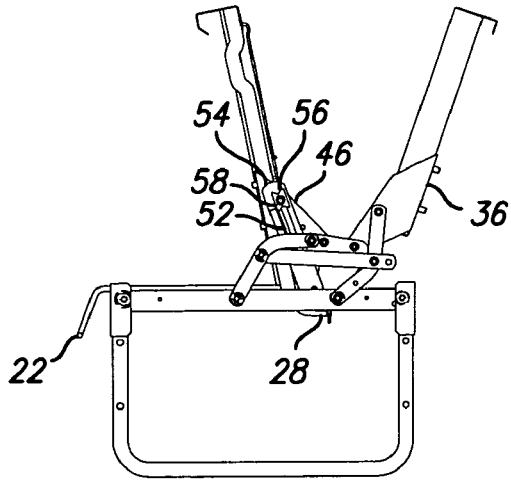
FIG. 5 is a side elevational view of the mechanism for a convertible sofa sleeper in the storage access position.
Figure 7:
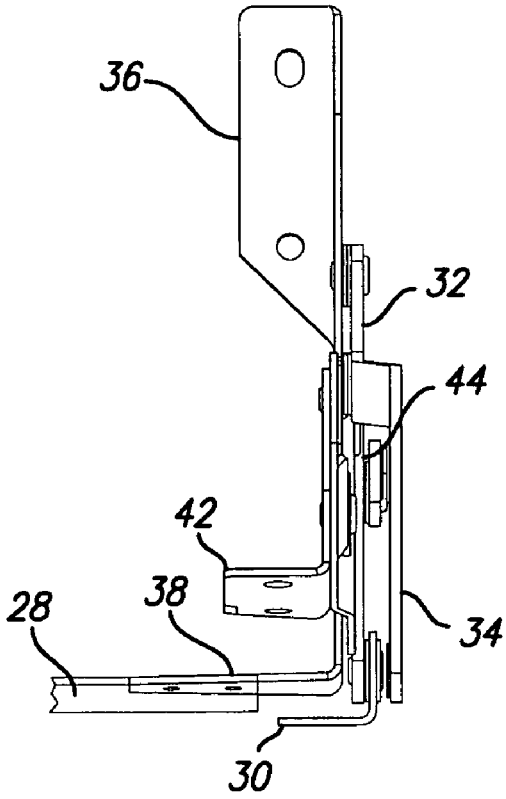
FIG. 7 is a front elevational view of the mechanism for a convertible sofa sleeper in the seating position.
Figure 8:
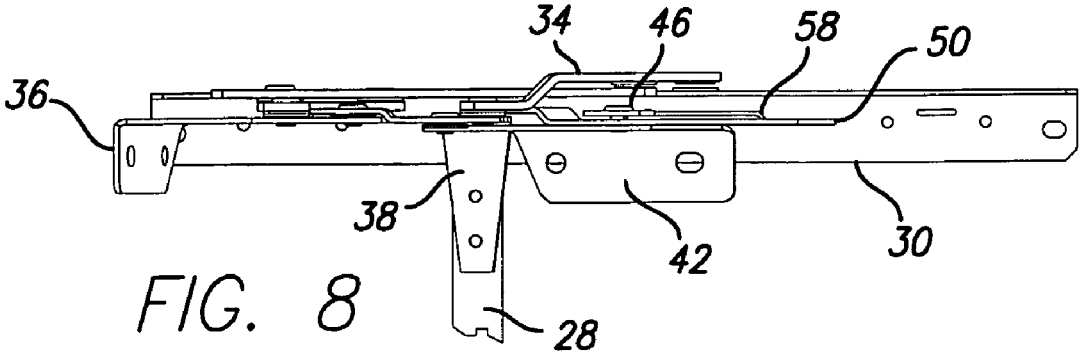
FIG. 8 is a top plan view of the mechanism for a convertible sofa sleeper in the seating position.

In the storage access operation, the seat bottom (16) is movable between a seat position (FIG. 4) and an open position (FIG. 5). The lock (50), or support feature is used to hold the seat up for storage access. A ratcheting lock tab (46) is riveted through the slot (52) in the lock bracket (44) and into the seat hinge (42). Said lock tab (46) is formed with two "V" shaped notches at opposite ends to form a "butterfly" shape.

When the seat is lifted up, the lock tab (46) rides along the slot (52). When lock tab (46) reaches the end (54) of the slot (52), the lock tab (46) hits a small lance (56) causing it to rotate about 45°. Lance (56) could be formed by stamping or pressing the sheet metal, or could be formed as a separate piece, such as a pin. The element can be referred to generically as a stop member, incorporating the lance, pin or other equivalents. As the seat (16) is lowered slightly the lock tab (46) catches on the lock guide (58) on the lock bracket locking the seat in an up position. The guide (58) could be formed separately and riveted or could be formed by stamping or pressing in sheet metal. It has also been found advantageous to add an e-ring behind the tab (46) to keep it from dragging and turning on bracket (44) as it moves in slot (52).

Rotation is permitted by clearance for tab (46) provided when rivet (60) is formed. When the operator lifts up on the seat again, the lock tab (46) hits the (56) again causing the lock tab (46) to rotate another 135° to straighten it out; thus allowing the seat to pivot back to a seating position.

The handle assembly (22) attaches to the bottom of the timing bar (38) with two bolts on each end. This handle assembly running side to side keeps the right and left linkages in time with one another. The rod handle part of the handle assembly (22) comes to rest "stop" at both extremes of the linkage cycle to lock the sofa in either a bed or sitting position.

Lock bracket (44) and travel of the lock tab (46) in the slot (52) limits the upward travel of the seat frame. The mechanism opens to an angle of roughly fifteen to thirty degrees from the vertical. The angular relationship between the raised seat and the seat back is between about 45 and as much as 60 degrees.

The interaction of lock bracket (44), ratcheting lock tab (46), rivet, slot (52), lance (56) and lock guide (58) on the bracket can sometimes be referred to as a "ratcheting support." This ratcheting support is distinguished from such alternatives as a rotating plate lock which operates by pins engaging and disengaging selected notches in the plate, this latter arrangement sometimes referred to as a dead bolt type lock, because of the action of the pins in the notches.

Figure 3:
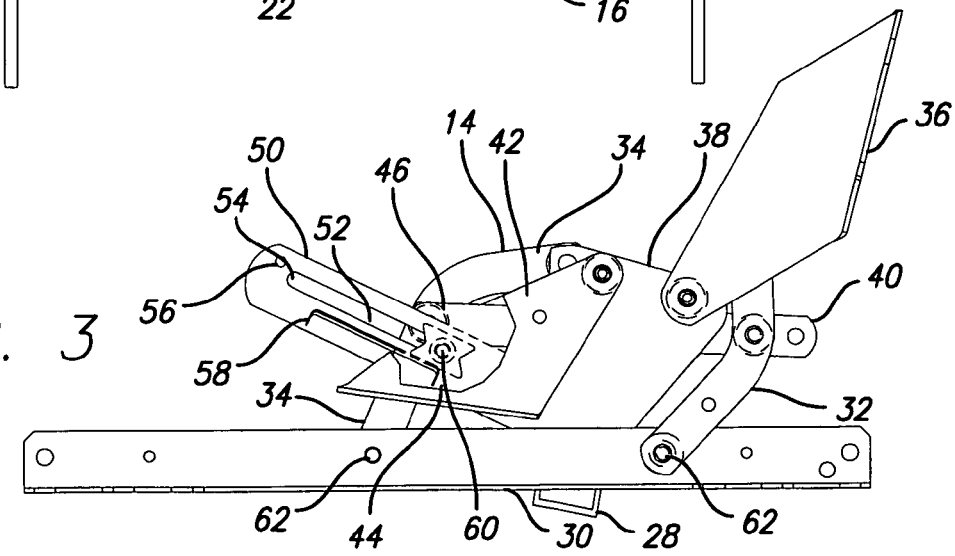
FIG. 3. is a side elevational view of the mechanism for a convertible sofa sleeper in the seating position.

As can be seen in the drawings, and particularly in FIG. 3, the seat hinge (42) is a generally triangular shape, with its base being parallel to the frame for the seat bottom. The swing bracket (38) is a tetragon of generally trapezoidal shape, oriented with its narrow side down, much like a 'keystone' shape. The back hinge (36) is a a tetragon, of generally deltoid shape, with one side parallel to the frame for the seat back. It will be understood that the exposed apexes of these shapes are typically rounded, without departing from the general relationship of the sides. The geometry of these components optimizes pivot location, motion and strength.

As will be understood by one of ordinary skill, the seat bottom and seat back will support cushions. The geometry of the linkage also provides advantages in the clearance between the open seat bottom and back in that the seat bottom is not permitted to travel closer than about 60 degrees from the angle of the seat back, thereby enabling opening and locking without crushing the cushions

I claim:

1. A convertible seat bed mechanism for recreational vehicles having a frame, a seat back and a seat bottom, said seat back and seat bottom shiftable between a seating position and a bed position through movement of interconnected seat and back hinge plates and front and rear swing links, and having a storage compartment under the seat bottom, comprising:

a swing bracket that is disposed between the seat and back hinge plates;

the seat bottom is adapted to pivot about said swing bracket;

the seat bottom is adapted to be raised by rotation of the seat hinge plate about a pivot to the swing bracket;

the seat bottom is supported by a ratcheting mechanism which permits the seat bottom to be raised to a storage access position and locked, and raised again to unlock and then lowered to a seating position, the unlocking being accomplished by cyclic motion and without the use of a separate release for lock;

the rear swing link and a front swing link are pivotally attached to a leg bracket at the lower ends of the respective links;

the back hinge plate is pivotally connected at the upper end of the rear swing link;

the bottom end of said back hinge plate is pivotally connected to said swing bracket at the top, rear of said swing bracket;

the top of front swing link is pivotally connected to the top, front of said swing bracket;

a swing tie link pivotally interconnects said front and rear swing links, and crosses but does not connect to, said swing bracket;

said locking mechanism is pivotally connected to said swing bracket and slidably and lockably interconnects said swing bracket and said seat bottom to permit the raising, said swing bracket having an inwardly turning flange;

that said flanges face one another;

a timing bar connected to said flange;

a handle attached to said timing bar such that motion imparted by said handle is directly transmitted to the swing bracket, aiding in the motion of the linkage shifting from a seating to a bed position;

the seat bottom and seat back in their open and locked position are angularly displaced from each other by an acute angle substantially greater than a parallel;

the angle between the open and locked seat bottom and the seat back, when the seat bottom is in the open and locked position, is maintained by said ratcheting mechanism pivotally connected to the seat hinge plate.

2. A convertible seat for recreational vehicles having a frame, a seat back and a seat bottom, said seat back and seat bottom shiftable between a seating position and a bed position through movement of interconnected seat and back hinge plates and front and rear swing links, and having a storage compartment under the seat bottom, comprising:

swing bracket that is disposed between the seat and back hinge plates;

the seat bottom is adapted to pivot about said swing bracket;

the seat bottom is adapted to be raised by rotation of the seat hinge plate about a pivot to the swing bracket;

the seat bottom is supported by a ratcheting mechanism which permits the seat bottom to be raised to a storage access position and locked, and raised again to unlock and then lowered to a seating position, the unlocking being accomplished by cyclic motion and without the use of a separate release for lock.

3. The invention of claim 2 further comprising:

a pair of said mechanisms forming left and right sides of a seat bed;

a pair of said swing brackets each having an inwardly turning flange arranged so that flanges face one another;

a timing bar spanning said flanges;

a handle attached to said timing bar such that motion imparted by said handle is directly transmitted to the respective swing bracket on each side of the seat bed, aiding in the motion of the linkage shifting from a seating to a bed position.

4. The invention of claim 2 said ratcheting mechanism further comprising a lock bracket having a longitudinal slot with a first end and a second end;

a butterfly shaped, ratcheting lock tab slidably and rotatably fastened through said slot;

said first end is fastened to said swing bracket;

a stop member located proximate said second end;

an offset track extending substantially the length of said slot and having a first edge and a second edge;

when said seat bottom is lifted, said lock tab travels along said slot;

when said lock tab reaches said second end, said lock tab hits said stop member causing said lock tab to rotate approximately 45°; as said seat bottom is lowered slightly, said lock tab catches said first edge of said offset track thereby locking the seat in an up position; when the seat is next lifted, said lock tab hits said stop member again causing said lock tab to rotate to align it with said slot, thus allowing the seat to pivot back to a seating position.

5. The invention of claim 4 further comprising:

a pair of said mechanisms forming left and right sides of a seat bed;

a pair of said swing brackets each having an inwardly turning flange arranged so that flanges face one another;

a timing bar spanning said flanges;

a handle attached to said timing bar such that motion imparted by said handle is directly transmitted to the respective swing bracket on each side of the seat bed, aiding in the motion of the linkage shifting from a seating to a bed position.

6. The invention of claim 2 further comprising:

the rear swing link and a front swing link are pivotally attached to a leg bracket at the lower ends of the respective links;

a back hinge is pivotally connected at the upper end of rear swing link at a pivot approximately in the middle of said back hinge;

the bottom end of said back hinge is pivotally connected to said swing bracket at the top, rear of said swing bracket;

the top of front swing link is pivotally connected to the top, front of said swing bracket;

a swing tie link pivotally interconnects said front and rear swing links, and crosses but does not connect to, said swing bracket;

said locking mechanism is pivotally connected to said swing bracket and slidably and lockably interconnects said swing bracket and said seat bottom to permit the raising, locking and lowering of said seat bottom to expose said storage area.

7. The invention of claim 2 further comprising:

the seat bottom and seat back in their open and locked position are angularly displaced from each other by an acute angle substantially greater than a parallel.

8. The invention of claim 7 further comprising:

the angle between the open and locked seat bottom and the seat back, when the seat bottom is in the open and locked position, is maintained by said ratcheting mechanism pivotally connected to the seat hinge.

9. A seat bottom opening and seat to sofa converting mechanism for moving a seat bottom frame and a seat back frame pivotally mounted on a leg frame comprising:

a seat hinge of generally triangular shape, with its base being parallel to the frame for the seat bottom, with a first pivoted apex;

a back hinge formed as a tetragon, of generally deltoid shape, with one side parallel to the frame for the seat back, with a second pivoted apex;

a swing bracket formed as a tetragon of generally trapezoidal shape, oriented with it's a first, narrow, side down, said swing bracket receiving the pivot for the first apex at a front apex of a second, wide, side opposite said first side, and receiving the pivot for the second apex at a rear apex of said second side;

movement of said mechanism between a seated position and a bed position being accomplished by imparting a force on said swing bracket, and translating motion through front and rear swing links attached to the seat and back hinges, respectively, said links being interconnected by a tie link; and movement of said seat bottom from a seating position to a storage position being controlled by a sliding lock that permits operation through a cycle of opening to an open position, lowering to a locked storage position, opening to an unlocked position and lowering to a closed position, with said cycle being the sole mechanical force operating said sliding lock.

10. The invention of claim 9, said sliding lock further comprising:

a lock bracket having a longitudinal slot with a first end and a second end;

a lock tab slidably and rotatably fastened through said slot;

said first end is fastened to said swing bracket;

a stop member located proximate said second end;

an offset track extending substantially the length of said slot and having a first edge and a second edge;

when said seat bottom is lifted, said lock tab travels along said slot;

when said lock tab reaches said second end, said lock tab hits said stop member causing said lock tab to rotate approximately 45°;

as said seat bottom is lowered slightly, said lock tab catches said first edge of said offset track thereby locking the seat in an up position;

when the seat is next lifted, said lock tab hits said stop member again causing said lock tab to rotate to align it with said slot, thus allowing the seat to pivot back to a seating position.

11. The invention of claim 10 further comprising:

a pair of said mechanisms forming left and right sides of a seat bed;

a pair of said swing brackets each having an inwardly turning flange arranged so that flanges face one another;

a timing bar spanning said flanges;

a handle attached to said timing bar such that motion imparted by said handle is directly transmitted to the respective swing bracket on each side of the seat bed, thereby imparting said force on said swing bracket.

12. The invention of claim 11 further comprising:

the seat bottom and seat back in their open and locked position are angularly displaced from each other by an acute angle substantially greater than a parallel.

13. The invention of claim 12 further comprising:

the angle between the open and locked seat bottom and the seat back, when the seat bottom is in the open and locked position, is maintained by said ratcheting mechanism pivotally connected to the seat hinge.

14. The invention of claim 13 further comprising:

the seat bottom and seat back in their open and locked position are angularly displaced from each other by an acute angle of about 60 degrees.

* * * * *